US006576299B1

(12) United States Patent
Pan et al.

(10) Patent No.: US 6,576,299 B1
(45) Date of Patent: Jun. 10, 2003

(54) COATING METHOD

(75) Inventors: Sean X. Pan, Penfield, NY (US); Cindy C. Chen, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/021,032

(22) Filed: Dec. 19, 2001

(51) Int. Cl.[7] ..... B05D 1/18; B05D 1/36; B05D 3/02

(52) U.S. Cl. ..... 427/430.1; 427/402; 427/372.2; 427/258

(58) Field of Search ..... 427/430.1, 402, 427/372.2, 258

(56) References Cited

U.S. PATENT DOCUMENTS

| | | | | | |
|---|---|---|---|---|---|
| 5,034,277 | A | * | 7/1991 | Laschewsky et al. | 428/411.1 |
| 5,385,759 | A | | 1/1995 | Crump et al. | 427/430.1 |
| 5,578,410 | A | | 11/1996 | Petropoulos et al. | 430/133 |
| 5,616,365 | A | | 4/1997 | Nealey | 427/430.1 |
| 5,633,046 | A | * | 5/1997 | Petropoulos et al. | 427/430.1 |
| 5,683,742 | A | | 11/1997 | Herbert et al. | 427/11 |
| 5,853,813 | A | | 12/1998 | Chambers et al. | 427/430.1 |
| 6,132,810 | A | | 10/2000 | Swain et al. | 427/430.1 |

FOREIGN PATENT DOCUMENTS

| | | |
|---|---|---|
| JP | 55 073369 | 6/1980 |
| JP | 62 254871 | 11/1987 |
| JP | 07 060183 | 3/1995 |

* cited by examiner

*Primary Examiner*—Michael Barr
(74) *Attorney, Agent, or Firm*—Zosan S. Soong

(57) ABSTRACT

A coating method for a substrate defining a deposition region and an optional uncoated region, wherein the deposition region includes an intermediate region disposed between a first end region and a second end region, the method composed of: (a) dip coating a first layer of a coating solution including a liquid medium and a coating material only over the first end region; and (b) dip coating a second layer of the coating solution over the first layer, the intermediate region, and the second end region in the recited sequence.

19 Claims, No Drawings

COATING METHOD

BACKGROUND OF THE INVENTION

When a photoreceptor is dip coated, the layer thickness increases slowly to a target value after the takeup speed reaches a constant value. The resulting non-uniformity in layer thickness is called "sloping." "Sloping" of the deposited layer over the imaging area of the photoreceptor is undesirable since it can degrade the performance of the photoreceptor. To prevent the deposited layer from exhibiting "sloping" in the imaging area, one can use a longer substrate to provide a longer non-imaging area so that the "sloping" of the deposited layer occurs only in the non-imaging area while the deposited layer exhibits relatively uniform thickness in the imaging area. However, a longer substrate and a longer non-imaging area increase costs since more materials have to be used in the substrate and the deposited layer or layers. Thus, there is a need, which the present invention addresses, for new methods to eliminate or reduce the above described problem.

Coating methods and apparatus are described in Petropoulos et al., U.S. Pat. No. 5,633,046; Herbert et al., U.S. Pat. No. 5,683,742; Swain et al., U.S. Pat. No. 6,132,810; Petropoulos et al., U.S. Pat. No. 5,578,410; and Crump et al., U.S. Pat. No. 5,385,759.

SUMMARY OF THE INVENTION

The present invention is accomplished in embodiments by providing a coating method for a substrate defining a deposition region and an optional uncoated region, wherein the deposition region includes an intermediate region disposed between a first end region and a second end region, the method comprising:

(a) dip coating a first layer of a coating solution including a liquid medium and a coating material only over the first end region; and (b) dip coating a second layer of the coating solution over the first layer, the intermediate region, and the second end region in the recited sequence.

There is also provided in embodiments a coating method for a substrate defining a deposition region and an optional uncoated region, wherein the deposition region includes an intermediate region disposed between a first end region and a second end region, the method comprising:

(a) dip coating a first layer of a coating solution including a liquid medium and a coating material only over the first end region;

(b) removing at least a portion of the liquid medium in the first layer, resulting in an at least partially dried first layer; and (c) dip coating a second layer of the coating solution over the at least partially dried first layer, the intermediate region, and the second end region in the recited sequence.

DETAILED DESCRIPTION

As used herein, the phrase "coating solution" encompasses any fluid composition including the liquid medium and the coating material regardless of the extent that the coating material may be dissolved in the liquid medium.

The substrate employed in the present invention defines a deposition region and an optional uncoated region, wherein the deposition region includes an intermediate region disposed between a first end region and a second end region. In embodiments where the present invention fabricates the substrate into an electrostatographic imaging member (e.g., a photoreceptor), one or more of the first end region, the second end region, and the optional uncoated region may correspond to a non-imaging area of the imaging member, whereas the imaging area of the imaging member includes at least the intermediate region and optionally one or both of the first end region and the second end region. In embodiments, the first end region, the second end region, and the optional uncoated region correspond to the non-imaging area of the imaging member, and the intermediate region corresponds to the imaging area.

The method involves dip coating a first layer of a coating solution including a liquid medium and a coating material only over the first end region. In embodiments, while dip coating of only the first end region is occurring, the intermediate region and the second end region are in contact with the coating solution; this can be accomplished for example by contacting the entire deposition region with the coating solution and then creating relative motion between the substrate and the coating solution to move only the first end region above the coating solution meniscus while the intermediate region and the second end region remain immersed in the coating solution below the coating solution meniscus.

In other embodiments, while dip coating of only the first end region is occurring, the intermediate region and the second end region are not in contact with the coating solution; this can be accomplished for example by using an elevating coating apparatus such as that described in Crump et al., U.S. Pat. No. 5,385,759, the disclosure of which is totally incorporated herein by reference, and pushing only the first end region through the reservoir apparatus to contact the coating solution, thereby depositing the first layer only on the first end region. The first end region is then pushed back in the opposite direction to prevent contact of the intermediate region and the second end region with the coating solution in the reservoir apparatus.

Subsequently, the method involves dip coating a second layer of the coating solution over the first layer, the intermediate region, and the second end region in the recited sequence.

The phrase "dip coating" encompasses the following techniques to deposit layered material onto a substrate: moving the substrate into and out of the coating solution; raising and lowering the coating vessel to contact the coating solution with the substrate; positioning the substrate in a vessel containing the coating solution and then draining the coating solution from the vessel.

The substrate may be moved into and out of the solution at any suitable speed including the takeup speed indicated in Yashiki et al., U.S. Pat. No. 4,610,942, the disclosure of which is hereby totally incorporated by reference. The dipping speed to contact the substrate with the coating solution may range for example from about 50 to about 3,000 mm/min and may be a constant or changing value. The takeup speed to withdraw the substrate from the coating solution may range for example from about 50 to about 500 mm/min and may be a constant or changing value. Any suitable dipping speed and takeup speed, including those discussed herein, can be used to deposit the first layer, the second layer, and any other desired layers.

The thickness of the first layer depends upon for instance the takeup speed, the immersion time in the coating solution, and the drying time. Illustrative takeup speeds and drying times are discussed herein. Any suitable immersion time may be employed such as from 0 to about 3 minutes, and particularly from 0 to about 30 seconds. The first layer has a thickness ranging for example from about 0.05 to about 50 micrometers, and particularly from about 1.5 to about 20 micrometers.

The thickness of the second layer depends upon for instance the takeup speed. Illustrative takeup speeds are discussed herein. The second layer has a thickness ranging for example from about 0.05 to about 75 micrometers, and particularly from about 3 to about 40 micrometers.

Unless otherwise indicated, the disclosed thickness values for the various layers are dry thickness values.

In embodiments, the second layer exhibits a substantially uniform thickness over the entire deposition region, particularly over the intermediate region. The phrase "substantially uniform thickness" indicates that the dry coating thickness over the deposition region varies by no more than about 10%, particularly no more than about 5%, based on the largest thickness value of the second layer.

In embodiments, the present method further involves depositing (by for example dip coating) a third layer including a different coating material over the entire deposition region prior to the dip coating of the first layer.

In embodiments, the present method removes at least a portion of the liquid medium in the first layer, resulting in an at least partially dried first layer. The removing of the portion of the liquid medium in the first layer is accomplished for example by exposing the first layer to ambient air for a time sufficient to evaporate the portion of the liquid medium into the ambient air. In embodiments, the first layer is exposed to the ambient air for a time ranging for example from 0 to about 3 minutes, including from about 5 seconds to about 3 minutes, and particularly from about 10 to about 20 seconds, where the ambient air is at a temperature ranging for example from about 0 to about 80 degrees C., and particularly from about 20 to about 30 degrees C. Optionally, drying apparatus such as a fan, a heater, a radiator, an ultrasonic wave generator or the like may be directed at the first layer to speed up the removal of the liquid medium. The at least partially dried first layer may exhibit a tacky quality. The amount of liquid medium to be removed depends on the coating solution properties of solid % and viscosity. The amount of liquid medium to be removed ranges for example from about 1 to about 100%, and particularly from about 2 to about 4%. In other embodiments, the amount of liquid medium to be removed ranges for example from about 0 to about 100%, and particularly from about 5 to about 25%. In embodiments, just enough liquid medium is removed from the first layer to render it tacky, thereby further minimizing any thickness variation. The amount of liquid medium removal from the first layer can be be optimized for the particular coating solution used.

In embodiments, the present method dip coats the second layer without removing liquid medium from the first layer or removes only an insignificant amount of the liquid medium from the first layer such that the film characteristics of the first layer are hardly changed.

In embodiments, while removal of a portion of the liquid medium from the first end region is occurring, the intermediate region and the second end region are in contact with the coating solution. This can be accomplished for example by contacting the entire deposition region with the coating solution prior to forming the first layer, and having the intermediate region and the second end region remain in contact with the coating solution during the dip coating of the first layer and the removing of the liquid medium portion from the first layer.

In other embodiments, while removal of a portion of the liquid medium from the first end region is occurring, the intermediate region and the second end region are not in contact with the coating solution. This can be accomplished by using the elevating coating apparatus, and moving the substrate in such a manner with respect to the reservoir apparatus containing the coating solution that in carrying out the dip coating of the first layer and the removal of the liquid medium portion from the first layer, no contact is made by the coating solution with the intermediate region and the second end region.

The present method is believed to be based on the phenomenon of "capillary retention." When liquid is placed on a horizontal surface that is rough with a raised area and a depressed area, liquid will distribute more in the depressed areas per unit area due to surface tension of liquid and gravity. When such rough surface with liquid is positioned vertically, the liquid will flow downward. The contact angle based on the smooth surface is higher in the raised area than in the depressed area. Capillary force will exert driving force for the liquid to flow from the raised area to the depressed area. As a result, there is a higher percentage of liquid in the raised area flowing out. The most solution is retained in the depressed area, especially in the lower positions due to gravity. After the raised area is dip coated, the capillary force and gravity drag and deposit more of the coating solution in the surface area following the raised area. In the present invention, the first layer functions as the raised area. Due to the presence of the first layer, more of the coating solution is deposited in the second layer over the intermediate region than would have occurred in the absence of the first layer. Consequently, greater deposition of the coating solution in the second layer over the intermediate region increases the coating thickness uniformity of the second layer over the intermediate region.

The present invention uses the same coating solution to form the first layer and the second layer, thereby minimizing or avoiding cross contamination if different materials are used for the two layers. The present method allows great process flexibility. The coating conditions of the first layer can be adjusted during the coating method based on the solution properties, coating environment, and product quality feedback, which may vary with time, process or material lots.

In embodiments of the present invention, an additional layer of the coating solution may be deposited over the first layer on only the first end region prior to deposition of the second layer. Procedures for depositing the additional layer may be similar to the procedures for depositing the first layer. The additional layer may be deposited over a wet, partially dry, or completely dry first layer. The combined thickness of the first layer and the additional layer would increase the surface height of the raised area, thereby potentially enhancing the coating thickness uniformity of the second layer over the intermediate region. In embodiments, the additional layer may be deposited only over the first end region and the second end region.

The substrate can be formulated entirely of an electrically conductive material, or it can be an insulating material having an electrically conductive surface. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include metals like copper, brass, nickel, zinc, chromium, stainless steel; and conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate can vary in thickness over substantially wide ranges depending on its desired use. Generally, the conductive layer ranges in thickness from about 50 Angstroms to about 30 micrometers, although the thickness can be outside of this range. When a flexible electrophotographic imaging member is desired, the substrate thickness typically is from about 0.015 mm to about 0.15 mm. When a rigid, hollow imaging member is desired, the substrate thickness is typically from about 0.5 mm to about 5 mm. The substrate can be fabricated from any other conventional material, including organic and inorganic materials. Typical substrate materials include insulating non-conducting materials such as various resins known for this purpose including polycarbonates, polyamides, polyurethanes, paper, glass, plastic, polyesters such as MYLAR® (available from DuPont) or MELINEX® 447 (available from ICI Americas, Inc.), and the like. If desired, a conductive substrate can be coated onto an insulating material. In addition, the substrate can comprise a metallized plastic, such as titanized or aluminized MYLAR®. The substrate can be flexible or rigid, and can have any number of configurations such as a cylindrical drum, an endless flexible belt, and the like.

The substrate and coating solution are described herein as being used in the fabrication of a photoreceptor. However, the present invention is not limited to the fabrication of a photoreceptor. In embodiments, the present invention uses other substrates and coating solutions not specifically described herein which are useful for other applications.

Any suitable coating solution can be used to form the layer or layers deposited over the substrate. In embodiments, the coating solution may comprise materials typically used for any layer of a photoreceptor including such layers as a charge barrier layer, an adhesive layer, a charge transport layer, and a charge generating layer, such materials and amounts thereof being illustrated for instance in U.S. Pat. No. 4,265,990, U.S. Pat. No. 4,390,611, U.S. Pat. No. 4,551,404, U.S. Pat. No. 4,588,667, U.S. Pat. No. 4,596,754, and U.S. Pat. No. 4,797,337, the disclosures of which are totally incorporated by reference.

In embodiments, a coating solution may include the materials for a charge barrier layer including for example polymers such as polyvinylbutyral, epoxy resins, polyesters, polysiloxanes, polyamides, or polyurethanes. Materials for the charge barrier layer are disclosed in U.S. Pat. Nos. 5,244,762 and 4,988,597, the disclosures of which are totally incorporated by reference.

The optional adhesive layer preferably has a dry thickness between about 0.001 micrometer to about 0.2 micrometer. A typical adhesive layer includes film-forming polymers such as polyester, du Pont 49,000 resin (available from E. I. du Pont de Nemours & Co.). VITEL-PE100™ (available from Goodyear Rubber & Tire Co.), polyvinylbutyral, polyvinylpyrrolidone, polyurethane, polymethyl methacrylate, and the like. In embodiments, the same material can function as an adhesive layer and as a charge blocking layer.

In embodiments, a charge generating solution may be formed by dispersing a charge generating material selected from azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochlorophthalocyanine, and the like; quinacridone pigments; or azulene compounds in a binder resin such as polyester, polystyrene, polyvinyl butyral, polyvinyl pyrrolidone, methyl cellulose, polyacrylates, cellulose esters, and the like. A representative charge generating solution comprises: 2% by weight hydroxy gallium phthalocyanine; 1% by weight terpolymer of vinyl acetate, vinyl chloride, and maleic acid; and 97% by weight cyclohexanone.

In embodiments, a charge transport solution may be formed by dissolving a charge transport material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds in a resin having a film-forming property. Such resins may include polycarbonate, polymethacrylates, polyarylate, polystyrene, polyester, polysulfone, styrene-acrylonitrile copolymer, styrene-methyl methacrylate copolymer, and the like. An illustrative charge transport solution has the following composition: 10% by weight N,N'-diphenyl-N,N'-bis(3-methylphenyl)-(1,1'-biphenyl)-4,4'diamine; 14% by weight poly(4,4'-diphenyl-1,1'-cyclohexane carbonate) (400 molecular weight); 57% by weight tetrahydrofuran; and 19% by weight monochlorobenzene.

A coating solution may also contain a liquid medium, preferably an organic liquid medium, such as one or more of the following: tetrahydrofuran, monochlorobenzene, and cyclohexanone.

After all the desired layers are coated onto the substrate, the coated layers may be subjected to elevated drying temperatures such as from about 100 to about 160° C. for about 0.2 to about 2 hours.

The invention will now be described in detail with respect to specific preferred embodiments thereof, it being understood that these examples are intended to be illustrative only and the invention is not intended to be limited to the materials, conditions, or process parameters recited herein. All percentages and parts are by weight unless otherwise indicated.

INVENTIVE EXAMPLE

An aluminum cylindrical substrate (outer diameter 30 mm, wall thickness 0.75 mm, and length 350 mm) was mounted onto an elevating coating apparatus. A charge transport solution of 300 centipoise was filled into the coating vessel component of the elevating coating apparatus. The substrate was positioned not to contact the solution at the beginning. The solution was made to contact the substrate by lowering the vessel. A first layer was deposited onto the substrate when the vessel was moved downward along the substrate for 15 mm at the speed of 120 mm per minute. The motion of the vessel was thereafter stopped and held still for 10 seconds. The vessel was then raised 15 mm along the substrate to the original position. The motion was then stopped and held still for 2 seconds. Thereafter, the vessel was moved downward along the substrate for 350 mm to the bottom of the substrate at the speed of 120 mm per minute to deposit the second layer. After the drum was held still for about 30 seconds, it was placed in a dryer at 120 degrees C. for 35 minutes. The thickness of the second layer along the drum was measured. The variation in thickness of the second layer was about 8% based on the largest thickness value of the second layer.

COMPARATIVE EXAMPLE

An aluminum cylindrical substrate (outer diameter 30 mm, wall thickness 0.75 mm, and length 350 mm) was mounted onto an elevating coating apparatus. A charge transport solution (same composition as the charge transport solution of Inventive Example) of 300 centipoise was filled into the coating vessel component of the elevating coating apparatus. The substrate was positioned not to contact the solution at the beginning. The solution was made to contact the substrate by lowering the vessel. A layer was deposited onto the substrate when the vessel was moved downward along the substrate for 350 mm to the bottom of the substrate at the speed of 120 mm per minute. After the drum was held still for about 30 seconds, it was placed in a dryer at 120 degrees C. for 35 minutes. The thickness of the layer along the drum was measured. The variation in thickness of the layer was about 10% based on the largest thickness value of the layer.

Thus, the Inventive Example exhibited an improvement in coating thickness uniformity of about 20% over the Comparative Example.

Other modifications of the present invention may occur to those skilled in the art based upon a reading of the present disclosure and these modifications are intended to be included within the scope of the present invention.

We claim:

1. A coating method for a substrate defining a deposition region and an optional uncoated region, wherein the deposition region includes an intermediate region disposed between a first end region and a second end region, the method comprising:

(a) dip coating a first layer of a coating solution including a liquid medium and a coating material only over the first end region; and (b) dip coating a second layer of the coating solution over the first layer, the intermediate region, and the second end region in the recited sequence, wherein the substrate is a hollow cylinder with open ends.

2. The method of claim 1, wherein the dip coating of the first layer is accomplished while the intermediate region and the second end region are in contact with the coating solution.

3. The method of claim 1, wherein the uncoated region is present.

4. The method of claim 1, wherein the coating solution is a charge transport solution.

5. The method of claim 1, wherein the first layer has a thickness ranging from about 0.05 to about 50 micrometers.

6. The method of claim 1, wherein the second layer has a thickness ranging from about 0.05 to about 75 micrometers.

7. The method of claim 1, wherein the second layer exhibits a substantially uniform thickness along the entire deposition region.

8. The method of claim 1, further comprising depositing a third layer including a different coating material over the entire deposition region prior to the dip coating the first layer.

9. A coating method for a substrate defining a deposition region and an optional uncoated region, wherein the deposition region includes an intermediate region disposed between a first end region and a second end region, the method comprising:

(a) dip coating a first layer of a coating solution including a liquid medium and a coating material only over the first end region;

(b) removing at least a portion of the liquid medium in the first layer, resulting in an at least partially dried first layer; and (c) dip coating a second layer of the coating solution over the at least partially dried first layer, the intermediate region, and the second end region in the recited sequence, wherein the substrate is a hollow cylinder with open ends.

10. The method of claim 9, wherein the dip coating of the first layer and the removing of the liquid medium are accomplished while the intermediate region and the second end region are in contact with the coating solution.

11. The method of claim 9, wherein the removing of the portion of the liquid medium in the first layer is accomplished by exposing the first layer to ambient air for a time sufficient to evaporate the portion of the liquid medium into the ambient air.

12. The method of claim 9, wherein the first layer is exposed to the ambient air for a time ranging from about 5 seconds to about 3 minutes.

13. The method of claim 9, wherein the at least partially dried first layer is tacky.

14. The method of claim 9, wherein the uncoated region is present.

15. The method of claim 9, wherein the coating solution is a charge transport solution.

16. The method of claim 9, wherein the first layer has a thickness ranging from about 0.05 to about 50 micrometers.

17. The method of claim 9, wherein the second layer has a thickness ranging from about 0.05 to about 75 micrometers.

18. The method of claim 9, wherein the second layer exhibits a substantially uniform thickness along the entire deposition region.

19. The method of claim 9, further comprising depositing a third layer including a different coating material over the entire deposition region prior to the dip coating the first layer.

* * * * *